US007845846B2

(12) United States Patent
Gerber et al.

(10) Patent No.: US 7,845,846 B2
(45) Date of Patent: Dec. 7, 2010

(54) RIBBON-DISPLAY TIMEPIECE

(75) Inventors: Francis Gerber, 103 Avenue Bois de la Chapelle, 1213 Onex (CH); Sébastien Rousseau, Les Pommerals (CH); Romain Gillet, Les Bois (CH)

(73) Assignee: Francis Gerber, Onex (CH)

( * ) Notice: Subject to any disclaimer, the term of this patent is extended or adjusted under 35 U.S.C. 154(b) by 133 days.

(21) Appl. No.: 12/294,430

(22) PCT Filed: Mar. 29, 2007

(86) PCT No.: PCT/EP2007/053034

§ 371 (c)(1),
(2), (4) Date: Oct. 3, 2008

(87) PCT Pub. No.: WO2007/110446

PCT Pub. Date: Oct. 4, 2004

(65) Prior Publication Data

US 2009/0161496 A1 Jun. 25, 2009

(30) Foreign Application Priority Data

Mar. 29, 2006 (EP) ..... 06111888

(51) Int. Cl.
*G04B 19/20* (2006.01)
*G04B 19/00* (2006.01)

(52) U.S. Cl. ..... 368/142; 368/40; 368/76; 368/223

(58) Field of Classification Search ..... 368/76, 368/40, 78, 140, 142, 222, 223
See application file for complete search history.

(56) References Cited

U.S. PATENT DOCUMENTS

| | | | | | |
|---|---|---|---|---|---|
| 1,027,518 | A | * | 5/1912 | Baumgartner-Hartmann | 368/40 |
| 1,439,120 | A | * | 12/1922 | Radtke | 368/40 |
| 1,536,647 | A | * | 5/1925 | Andresen | 368/40 |
| 1,998,763 | A | | 4/1935 | Janson | |
| 2,072,457 | A | * | 3/1937 | Larrabee | 368/56 |
| 2,775,092 | A | * | 12/1956 | Howard | 368/40 |
| 2,790,300 | A | * | 4/1957 | Lux | 368/40 |
| 3,353,347 | A | * | 11/1967 | Gates et al. | 368/40 |
| 4,022,015 | A | * | 5/1977 | Bailey | 368/40 |
| 5,331,609 | A | | 7/1994 | Gubin | |

FOREIGN PATENT DOCUMENTS

| | | | |
|---|---|---|---|
| CH | 338 150 | A | 4/1959 |
| WO | 2004/006026 | A2 | 1/2004 |

* cited by examiner

*Primary Examiner*—Vit W Miska
*Assistant Examiner*—Sean Kayes
(74) *Attorney, Agent, or Firm*—Young & Thompson

(57) ABSTRACT

A timepiece includes a flexible endless ribbon (10) bearing time indications (13, 14) and stretched between two parallel rollers (11, 12), and a mechanism for turning at least one of these rollers including a spring wound up inside a barrel, an escapement and a regulator member coupled to the escapement. The spring is wound up inside at least one of the rollers which thus forms the barrel of the drive mechanism.

10 Claims, 3 Drawing Sheets

RIBBON-DISPLAY TIMEPIECE

TECHNICAL FIELD

The present invention relates to the field of horology. It more particularly concerns a timepiece in which time information is displayed using an endless ribbon turning around the movement inside the case, the information borne by this ribbon appearing through the glass.

BACKGROUND ART

A watch of this type is described, for example, in patent CH 338 150. A mechanical movement, of the traditional type, is topped by a U-shaped stirrup whereof the base is passed through by the cannon-pinion. This drives two vertical wheels mounted pivoting in the branches of the stirrup and turning at speeds whereof the ratio is that of the angular speeds of the hands of a traditional watch. These two wheels are respectively engaged with the toothings presented by two endless ribbons arranged next to each other, around the movement, and one bearing the minute information, the other the hour information.

This type of construction does, however, suffer two main drawbacks. First, the power and the energy of the spring contained in the barrel risk being insufficient to drive the ribbon over an acceptable period of time. Secondly, the watch is very thick because it is made up of the stack of a movement, the drive mechanism of the ribbon and a sufficient space to allow the latter part to revolve around the assembly.

SUMMARY OF THE INVENTION

The present invention aims to provide a ribbon-display timepiece free from these two drawbacks.

More precisely, the timepiece is of the type comprising a flexible endless ribbon bearing time information and stretched between two parallel rollers, and a mechanism driving at least one of these rollers in rotation, comprising a spring wound up inside a barrel, an escapement and a regulator member coupled to the escapement. This piece is characterized in that the spring is wound up inside at least one of the rollers which thereby forms the barrel of the drive mechanism.

Advantageously, the two rollers are identical and constitute barrels which are coupled identically, via a train, to a unique escapement and regulator member located halfway between the two.

BRIEF DESCRIPTION OF THE DRAWINGS

Other characteristics of the invention will appear from the following description, done in reference to the appended drawing, in which.

MODE(S) FOR CARRYING OUT THE INVENTION

Figure 1:
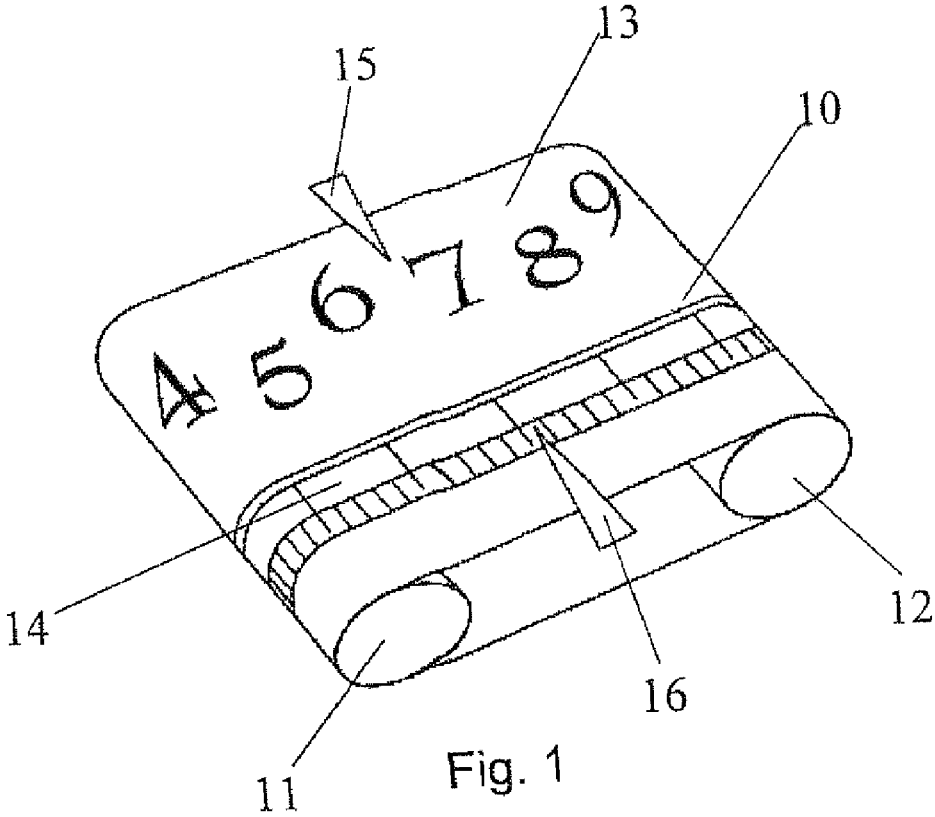
FIG. 1 is a partial perspective view of a watch movement according to the invention.

To begin, we will refer to FIG. 1 which shows, in 10, a flexible endless ribbon stretched between two parallel identical rollers 11 and 12 simultaneously turned by a mechanism which will be described in detail below. During their rotation, these rollers move the ribbon in the counterclockwise direction, at a rate of one or several complete rotations per day.

The flexible ribbon 10 can be made of silk, metal, plastic, paper or any other material. It has side by side, arranged perpendicular to the rollers and made by printing, a scale 13 bearing the hour information from 0 to 11 and may have a scale 14 bearing, across from the space separating two successive hour indications, minute information. In this case, the ribbon completes one rotation in 12 hours. Of course, the scale 13 can also bear the indications of the hours from 0 to 23, in which case the ribbon completes its rotation in 24 hours.

Two fixed hands 15 and 16, arranged above the ribbon 10, serve as references for reading the hours and minutes. These hands can simply be fixed under the glass of the watch, but they can also be fixed to the movement itself or in any way which is suitable for one skilled in the art.

According to one essential characteristic of the invention, the rollers 11 and 12 which serve to drive the ribbon 10 are themselves the energy source for the movement, i.e. they form the barrels and therefore each contain a spring whereof the relaxation, over time, ensures their rotation and, thus, the movement of the ribbon.

Although this is not illustrated in the drawing, it can be advantageous to provide the rollers, at their ends, with toothings engaged with openings formed along the edges of the ribbon, like those of photographic film. Driving of the ribbon is thus made more reliable. In this case, however, in order to allow the sliding of the ribbon to set its time, the toothings of the rollers must be frictionally mounted thereon.

To solidify this idea, and as a simple example, the distance separating the two rollers 11 and 12 is 21.99 mm, while their diameter is 7 mm. The ribbon 10, stretched between these rollers, therefore has a length of 73.79 mm. To allow this to perform one complete rotation in 12 or 24 hours, the rollers 11 and 12 must therefore, under the action of their respective springs, complete 3.35 or 6.7 revolutions per day, respectively.

The length of the rollers, typically approximately 15 mm, allows them to form barrels provided with a spring having, thanks to its significant height, a maximum turning moment exceptionally higher than that of the spring of a traditional barrel. If a single spring with a substantial height is not available, one need only, for example, couple several elementary springs of traditional movements side by side on the core of the barrels, which makes it possible to easily achieve a maximum turning moment of 20 Nmm for each of them. Driving of the ribbon, even if it is relatively heavy, then no longer poses any problem in terms of power and energy. A power reserve greater than 48 hours is thus offered.

Figure 3:
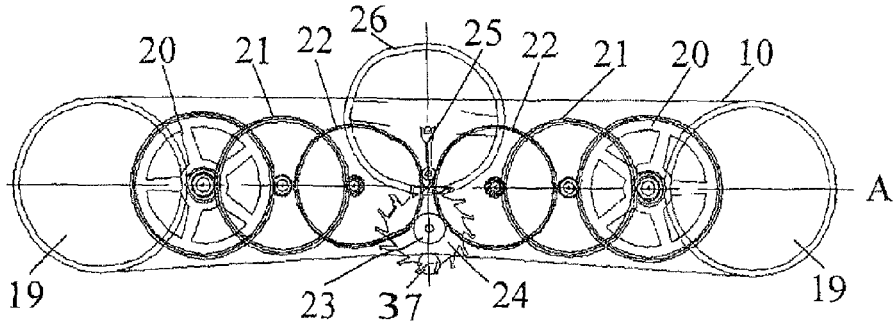
FIG. 3 is a side view of the movement.
Figure 2:
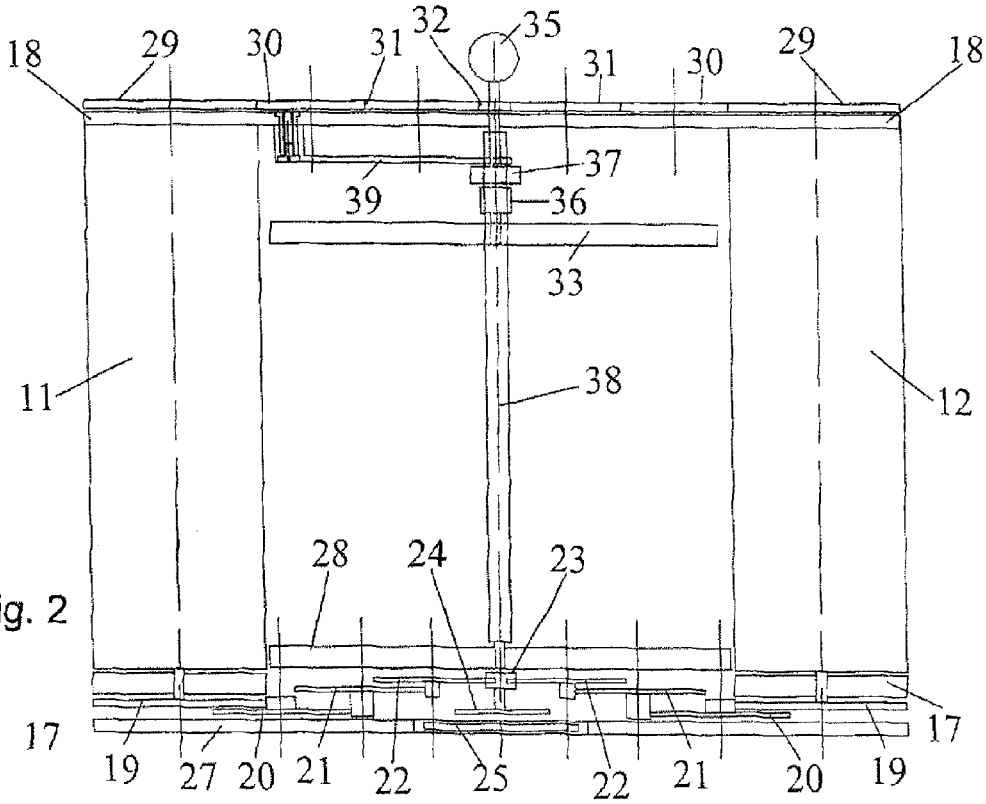
FIG. 2 is a top view of this movement, with the ribbon removed.
Figure 4:
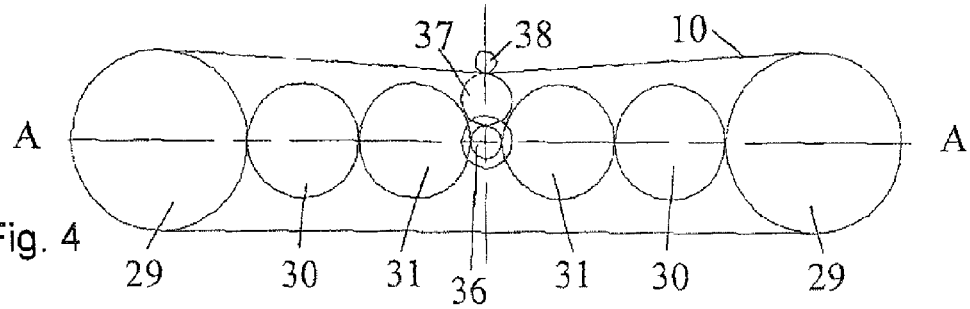
FIG. 4 is a view of the other side of the movement.

We will now refer to FIGS. 2 to 4 showing the movement of the invention, which, to be better visible, was separated from its ribbon.

From its side illustrated in FIG. 3, each roller 11 and 12, which turns counterclockwise, is mounted pivoting between two bridges 17 and 18. It ends with a barrel wheel 19 engaged with the pinion of a center wheel 20 whereof the wheel is engaged with the pinion of a third-wheel 21 whereof the wheel is engaged with the pinion of a second wheel 22.

The two second wheels 22 mesh, halfway between the two rollers, with the pinion 23 of an escapement wheel 24 also turning counterclockwise and coupled, traditionally, via a pallet 25, to a spiral balance 26 forming a regulator member. One will note that, for obvious reasons of reducing the thickness of the movement, the axis of the escapement pinion 23 is offset relative to the line AA joining the axes of the two barrels on which the axes of the wheels 20, 21 and 22 are aligned. All of these wheels are mounted pivoting between two bridges 27 and 28.

From its side illustrated in FIG. 4, each roller 11 and 12 ends with a ratchet 29 meshing, halfway between the two rollers, via two countershafts 30 and 31, with a central winding pinion 32 arranged on the line AA along which the axes of the wheels 30 and 31 are arranged. The latter parts are mounted pivoting between a bridge 33 and the bridge 18 used by the rollers.

Figure 5:
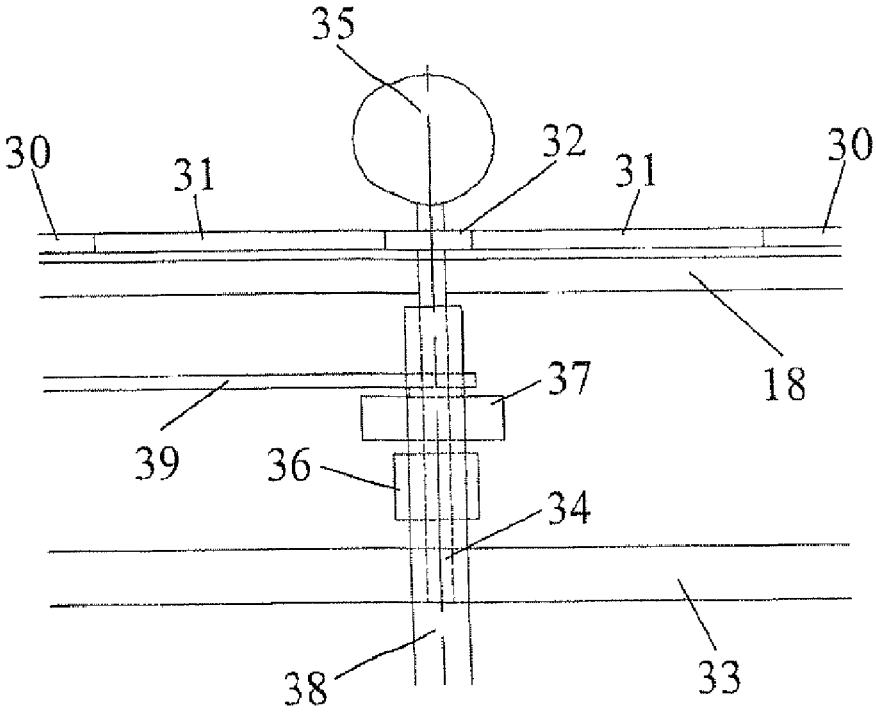
FIGS. 5 and 6 show the details of the winding and setting mechanism.
Figure 6:
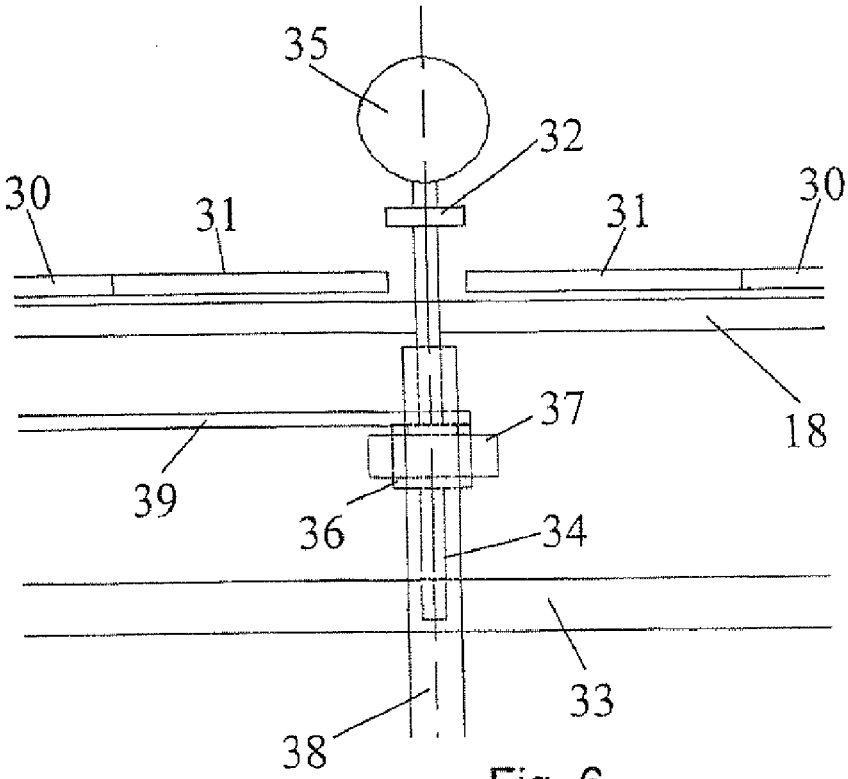

The bridges 17, 18, 27, 28 and 33 are advantageously assembled using a system of shafts (not illustrated) forming, in a way, the plate of the movement. FIGS. 5 and 6 show, as an example, the manner in which the winding and setting functions of this movement are performed.

The winding pinion 32 belongs to a central winding stem 34, parallel to the axes of the rollers 11 and 12, able to be actuated in rotation and in translation using a crown 35 and mounted between the bridges 18 and 33. It bears a pinion 36 which, in the pushed in position of the stem 34, illustrated in FIG. 5, is inactive. In this case, the pinion 32 is, as in FIG. 2, engaged with the two ratchets 29. The rotation of the crown 35 then allows winding of the springs of the two barrels 11 and 12.

When, as shown in FIG. 6, the stem 34 is in the pulled out position, the winding pinion 32 is inactive but the pinion 36 engages, below it, with a pinion 37 fixed on a central shaft 38, advantageously provided with grooves, which is mounted free in rotation between the bridges 28 and 33 parallel to the axes of the rollers 11 and 12. FIG. 4 shows that this shaft is applied over the entire width of the ribbon which it slightly deforms inwardly. The rotation of the crown 35 then makes it possible, through the friction exerted by the shaft 38 on the ribbon, to move this so as to ensure its setting across from the hands 15 and 16. One will lastly note that a strip spring 39, arranged from the side of the pinion 37 opposite the side from which the pinion 36 arrives, serves for correct positioning of this.

Figure 7:
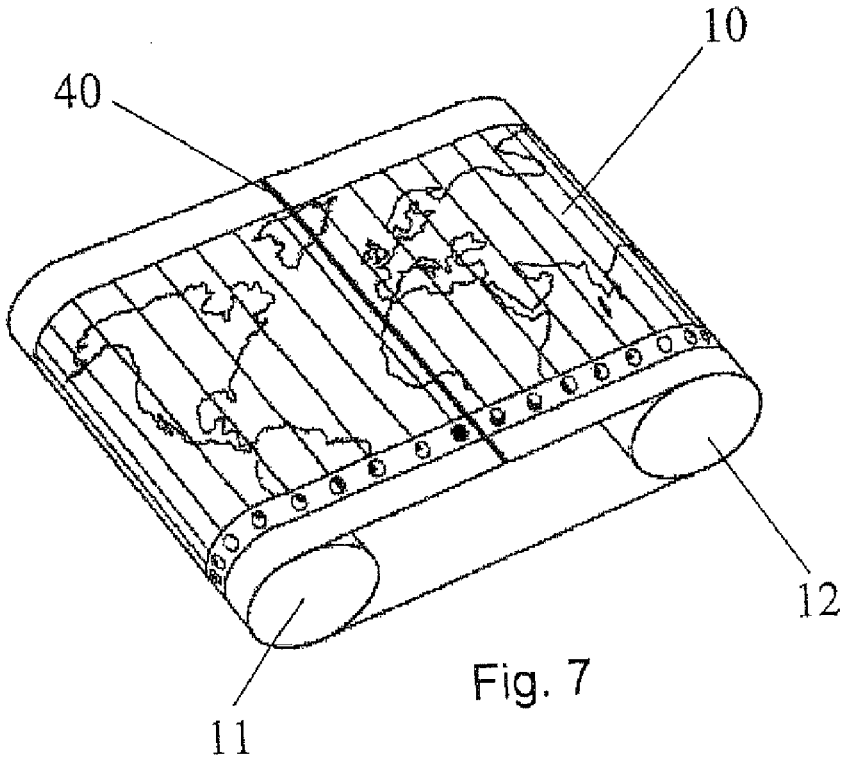
FIG. 7 illustrates a variation of embodiment of the movement of FIG. 1.

Thus is proposed a timepiece provided with a ribbon display which presents the originality of using the two driving rollers as barrels. A significant volume is thus made available to house springs which provide all of the power and energy needed for more-than-comfortable reliable and independent operation. The present description was done in reference to a ribbon displaying the hour and minute. It goes without saying that a number of other indications can thus be provided by such a movement, with an infinite number of possibilities for offering the most original esthetic effects. FIG. 7 shows, as an example, the possibility of using a ribbon 10 displaying the time zones. A fixed line 40 then serves as a reference for reading times.

One will lastly note that, according to one variation of embodiment, the timepiece according to the invention can use only one of the rollers as a barrel.

The invention claimed is:

1. A timepiece comprising:

a flexible endless ribbon bearing time indications and stretched between two parallel rollers, and a drive mechanism for turning at least one of said rollers, said drive mechanism comprising a spring wound up inside a barrel, an escapement and a regulator member coupled to the escapement, wherein said spring provides all the energy that drives said drive mechanism and is wound up inside one of said rollers which thus forms the barrel of the drive mechanism.

2. The timepiece according to claim 1, wherein, in said drive mechanism, the two rollers are identical and form barrels which are coupled identically, by one of their ends, via a train, to an escapement and regulator member located substantially halfway between the two.

3. The timepiece according to claim 2, wherein said drive mechanism is configured such that the ribbon completes one or several complete rotations in 24 hours.

4. The timepiece according to claim 2, wherein the spring contained in the rollers is formed by a plurality of elementary springs arranged side by side.

5. The timepiece according to claim 4, wherein, to allow winding of the two springs, each roller ends with a ratchet meshing, substantially halfway between the two rollers, via a train, with a central winding pinion which is actuated by a control stem.

6. The timepiece according to claim 5, wherein, to allow setting of the ribbon, the control stem turns a shaft arranged parallel to the two rollers in contact with the ribbon, so as to exert a friction thereon which causes the ribbon to slide on the rollers.

7. The timepiece according to claim 2, wherein, to allow winding of the two springs, each roller ends with a ratchet meshing, substantially halfway between the two rollers, via a train, with a central winding pinion which is actuated by a control stem.

8. The timepiece according to claim 7, wherein, to allow setting of the ribbon, the control stem turns a shaft arranged parallel to the two rollers in contact with the ribbon, so as to exert a friction thereon which causes the ribbon to slide on the rollers.

9. The timepiece according to claim 1, wherein said drive mechanism is configured such that the ribbon completes one or several complete rotations in 24 hours.

10. The timepiece according to claim 1, wherein the spring contained in the rollers is formed by a plurality of elementary springs arranged side by side.

* * * * *